US006158065A

United States Patent [19]

Tuoriniemi et al.

[11] Patent Number: 6,158,065

[45] Date of Patent: Dec. 12, 2000

[54] BABY BATH TUB

[76] Inventors: Frances Kyra Tuoriniemi; Veijo Matias Tuoriniemi; Cornelia Frances Tuoriniemi, all of 50 Horatio St. #16, New York, N.Y. 10014-1675

[21] Appl. No.: 09/317,684

[22] Filed: May 24, 1999

Related U.S. Application Data

[60] Provisional application No. 60/086,433, May 22, 1998.

[51] Int. Cl.[7] ..... A47K 3/024

[52] U.S. Cl. ..... 4/538; 434/247; 434/433

[58] Field of Search ..... 4/538, 488, 572.1, 4/513, 584, 586, 567, 568; 434/247, 433

[56] References Cited

U.S. PATENT DOCUMENTS 4,216,552 8/1980 Gurolnick ..... 4/572.1

5,033,131 7/1991 Paden ..... 4/568

5,926,866 7/1999 Chao ..... 4/572.1

*Primary Examiner*—Charles R. Eloshway

*Attorney, Agent, or Firm*—Charles E. Bruzga

[57] ABSTRACT

A portable top-opening receptacle for holding water for a child bathing in standing position having a horizontal bottom and having a sufficient diameter to accommodate use by a child for standing. A round vertical wall keeps water inside of said receptacle, having a sufficient height to provide water at least to the waist level. The receptacle being laterally dimensioned so that the child can rest it's buttocks on a wall of the receptacle behind the child while holding onto a wall of the receptacle in front of the child providing an infant a facility to practice standing.

4 Claims, 4 Drawing Sheets

BABY BATH TUB

This application claim benefit to provisional application 60/086/433 filing May 22, 1998.

FIELD OF INVENTION

This invention relates to bathtubs, especially to bath tubs used to bathe infants and toddlers.

BACKGROUND OF THE INVENTION

Baby bath tubs are conventionally horizontal, where infant is placed on back in laying position while washing him/her.

OBJECTS AND ADVANTAGES

Parent can take baby to shower with him/herself and have baby standing in bathtub beside him/herself.

Baby can stand in water and take support from the side of the tub. Baby feels her/himself lighter in water and is encouraged to stand. If the baby loses balance the vertical walls will support her from falling.

Further embodiment provides an extension capability. The height of the bathtub can be adjusted to the height of the child. Adjustable height makes the tub more secure and more enjoyable for a child.

DRAWING FIGURES

LIST OF REFERENCE NUMERALS

10 bottom 24 chest water level

12 wall 26 waist water level

Figure 1:
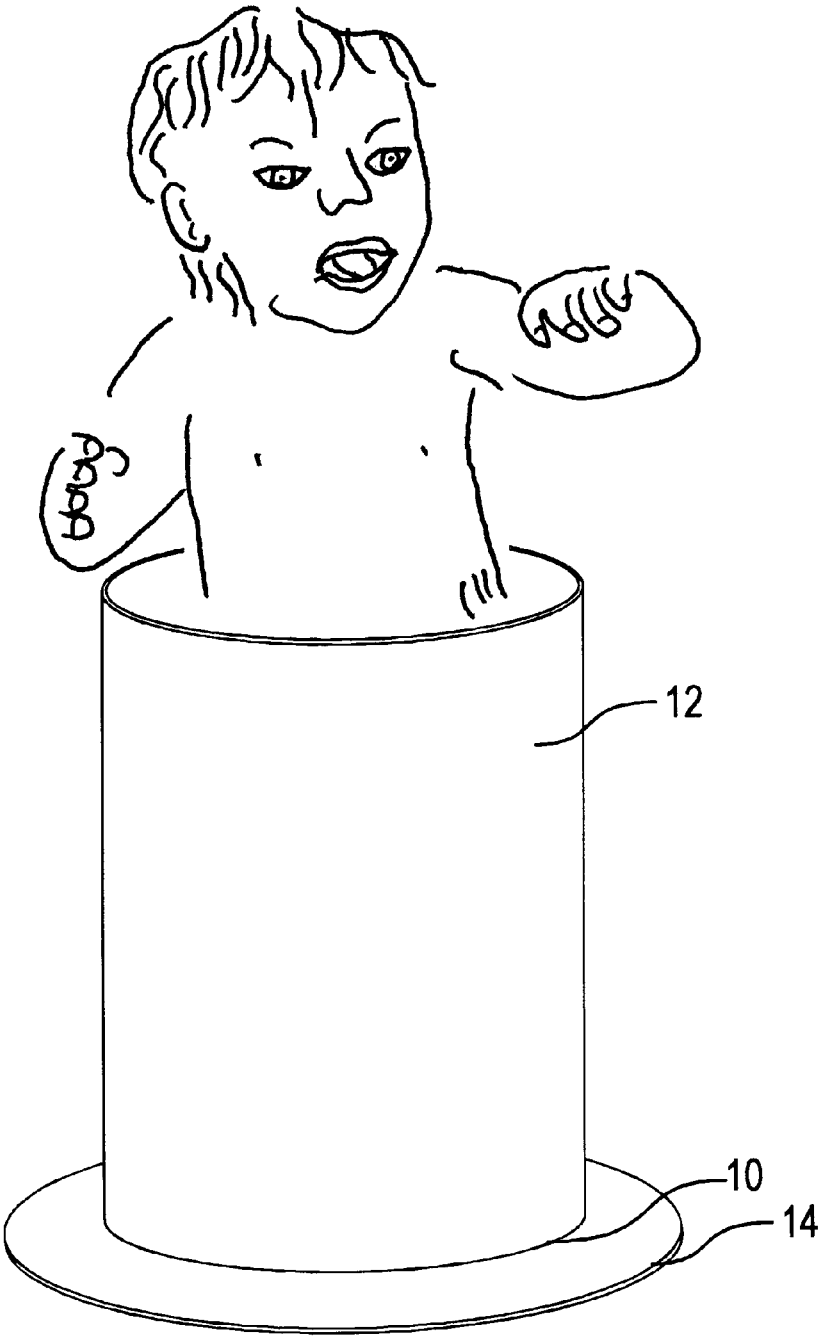
FIG. 1 shows an upper perspective view of the bathtub with a child using it.

14 extended bottom part 28 knee length, minimum diameter

16 wall extension 30 maximum straight standing diameter

18 adjusting threads 32 diameter reachable by bending from waist

20 adjusting ring

22 gasket/washer

DESCRIPTION OF THE FIRST EMBODIMENT

Figure 5:
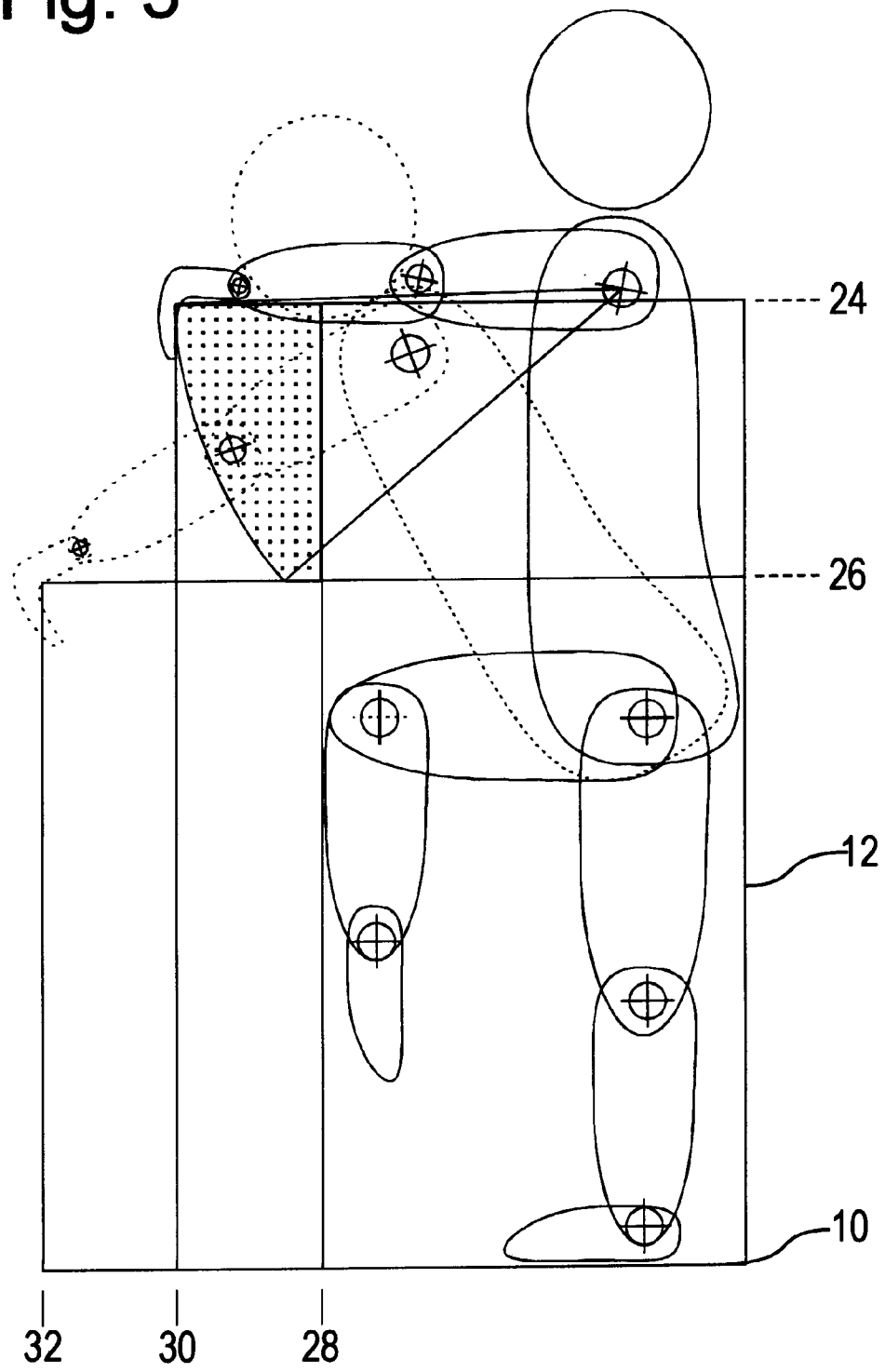
FIG. 5 shows useful measurement relation between diameter and height.

FIG. 1 shows a preferred embodiment of a bath tub. The tub is cylindrical; having a circular bottom 10 and vertical wall 12. The diameter of the tub is preferably between 20–30 cm. In general, the height should be at least 1.5 times the diameter of the bottom. Preferred height is to chest level 24 (FIG. 5). Minimum height is waist level 26. The diameter of the bath tub shouldn't be less than knee length. Too tight tub might cause jamming to the tub and drowning. Maximum straight standing diameter of the tub is reached when user stands in upright position buttocks touching the wall behind her/him and hands are straightened and the grip is comfortable from the upper edge of the tub. Best diameter/height combination area is highlighted by dots. In this area hands are kept straight, buttocks touch the wall and knees have enough room.

The tub is preferably made out of polymeric material. Different methods can be used, but preferably it should made by extruding.

The bottom of the tub can have anti-slippery treatment to prevent the tub from moving.

It can also be fixed to the bottom of a shower stall by one or more suction cups or other known manner.

The bottom of the tub can also have a layer, which adjusts itself to follow the contour of the ground where it is standing.

When the child is holding herself up against the wall in front of her, she/he is able to touch the wall behind her/him with her buttocks (FIG. 5). The knowledge of support behind her encourages her to release her hands and stand in upright position without hand support.

This confidence building and experience facilitates the child's experimentation with standing and walking.

Resistance from the water slows down movements making the early attempts at standing more fluid. Thereby what might be sudden jerky movement in the air is more controllable and smoother in the water. The buoyancy created by the water offers a child the chance to practice standing more easily and earlier in the water, because the muscles have less weight to support.

Also, a child of this age often prefers to test their new abilities and therefore does not like to be laid down and bathed in a traditional tub. A happy baby is easier to wash.

OPERATION OF THE FIRST EMBODIMENT

The bathtub is filled with water and child is placed to stand in the tub. The wider the tub bottom, the more difficult it is for a child to tip it over. The more there is water in the tub, the more secure it will be.

The chest level height walls prevent a child from leaning out of the tub and moves the equilibrium point of the tub-water-child combination outside of the vertical walls. High walls also prevent a child from jumping out of the tub unexpectedly.

The top of the chest level high walls provides a child an armrest where he/she can lean.

DESCRIPTION OF THE SECOND EMBODIMENT

Figure 2:
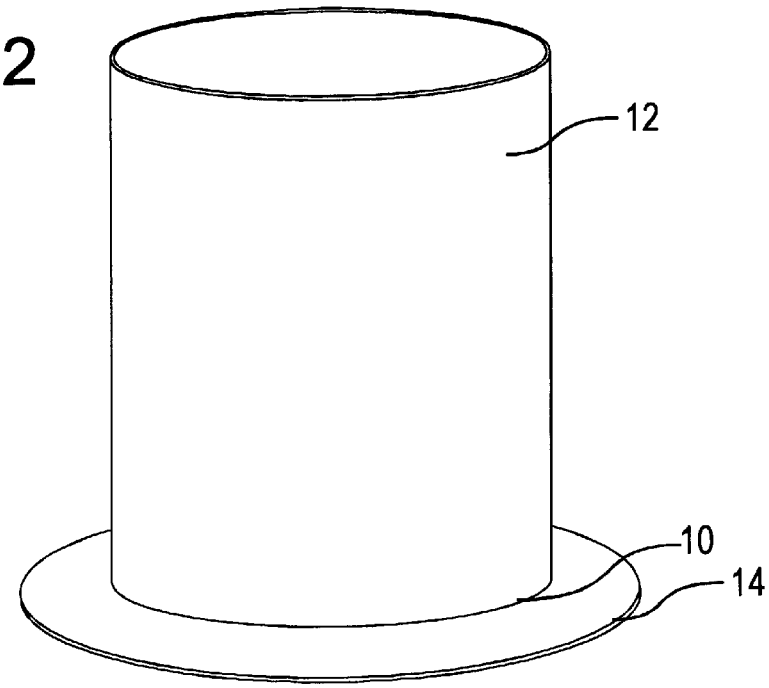
FIG. 2 shows a bathtub with an extended bottom part.

FIG. 2 shows an embodiment having an extended bottom part 14. The extension prevents the tub from falling if the child leans over the wall 12. The extension can be extruded and thus an integral part of the tub or it can be made separately from preferably softer, flexible material, which would follow the contour of the bottom of the shower stall or bathtub where it is placed.

DESCRIPTION OF THE THIRD EMBODIMENT

Figure 3:
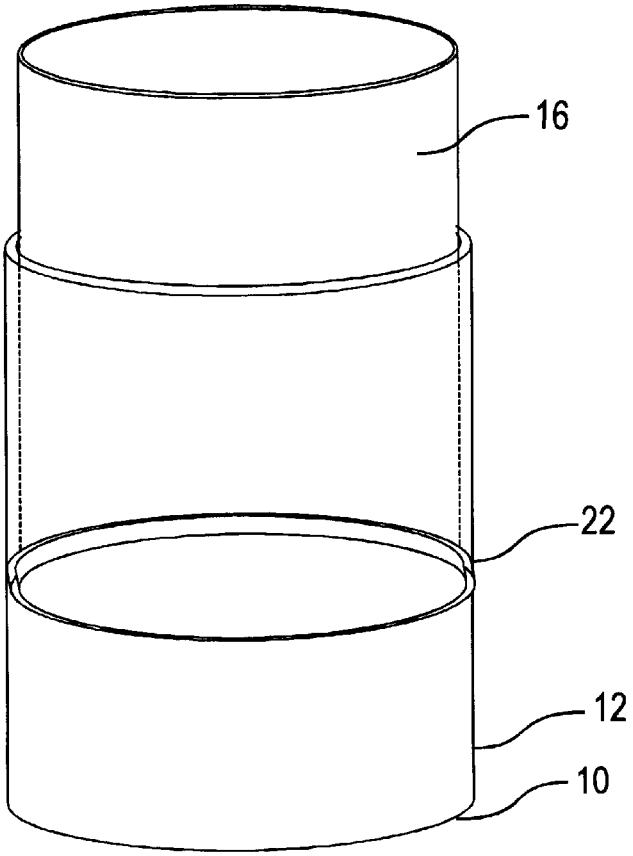
FIG. 3 shows the bathtub with telescoping wall.

FIG. 3 shows a third embodiment, having telescoping walls. The wall is made out of two parts: one part slides over the other. By moving the upper part the height of the tub can be adjusted to a desired level.

The bathtub can have a silicone rubber gasket 22 between the upper and lower wall preventing the joint from leaking. Preferably the parts can be secured on the selected level so the if the child leans on the wall, it doesn't slide down.

DESCRIPTION OF THE FOURTH EMBODIMENT

Figure 4:
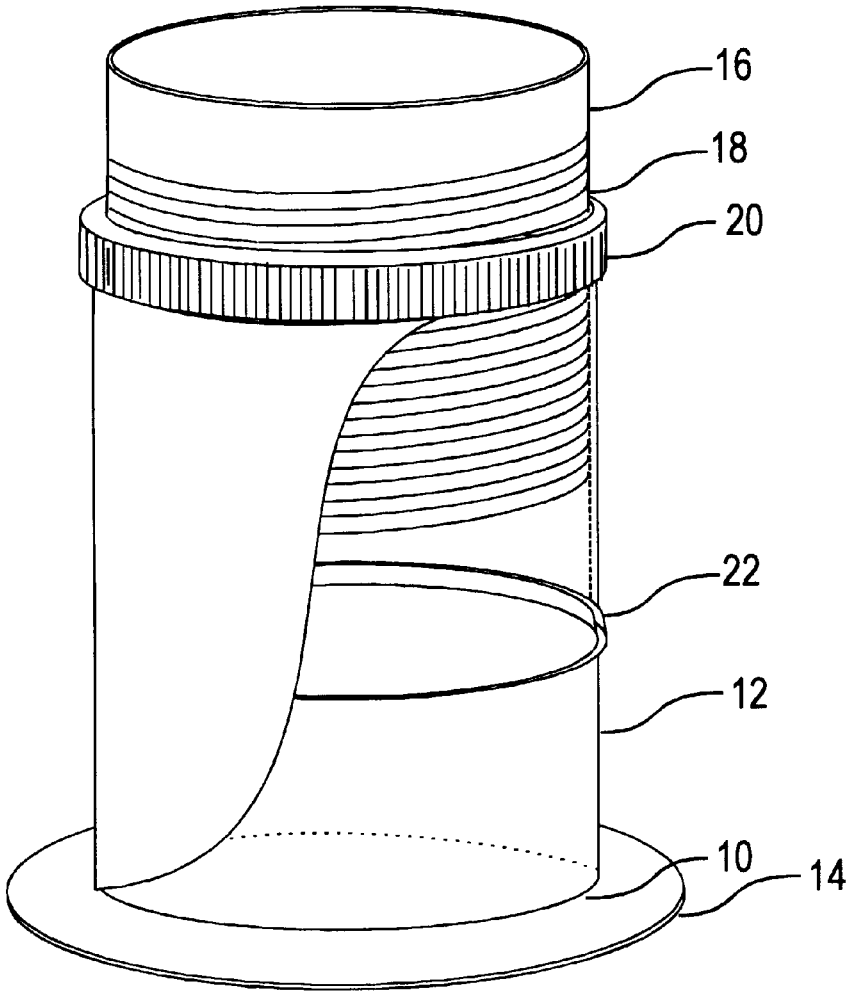
FIG. 4 shows a perspective cross sectional view of a bathtub with an adjustment ring

FIG. 4 shows an adjustable height bathtub. By moving the upper part the water level can be adjusted to desired level.

One can move the upper part by turning the adjustment ring 20. Ring has a threads on inner rim. The counter part of the thread is in on outer surface of the wall extension 16.

We claim:

1. A method of supporting a child in a standing position, comprising the steps of:

(a) providing a water-holding, top-opening receptacle formed with a laterally surrounding wall extending higher than the child's waist;

(b) laterally dimensioning the receptacle so that the child can rest it's buttocks on a wall of the receptacle behind the child while holding onto a wall of the receptacle in front of the child;

(c) placing the child in the receptacle (d) placing sufficient water in the receptacle to provide substantial buoyancy for the child.

2. The method of claim 1 further comprising the step of providing a means to stabilize the receptacle to prevent said receptacle from falling if the center of gravity of said child, said bath tub and said water combined is moved outside said wall.

3. The method of claim 2 wherein said means comprises a flange extending outwardly from the bottom of the receptacle.

4. The method of claim 1 including the step of placing a pre-walking child in the receptacle.

* * * * *